US007571965B1

(12) United States Patent
Perry

(10) Patent No.: US 7,571,965 B1
(45) Date of Patent: Aug. 11, 2009

(54) MOLDED FOAM POOL CHAIR

(76) Inventor: Michael L. Perry, 2401 Fain St., Wichita Falls, TX (US) 76308

( * ) Notice: Subject to any disclaimer, the term of this patent is extended or adjusted under 35 U.S.C. 154(b) by 0 days.

(21) Appl. No.: 12/192,922

(22) Filed: Aug. 15, 2008

Related U.S. Application Data

(60) Provisional application No. 60/965,026, filed on Aug. 16, 2007.

(51) Int. Cl.
*A47C 7/02* (2006.01)
*A47C 7/00* (2006.01)

(52) U.S. Cl. ..... 297/452.26; 297/440.16

(58) Field of Classification Search ..... 297/452.27, 297/452.26, DIG. 1, DIG. 2, 440.16, 452.24; 441/130, 131, 132, 129
See application file for complete search history.

(56) References Cited

U.S. PATENT DOCUMENTS

D169,366 S * 4/1953 Feldman ..... D6/596
3,067,441 A * 12/1962 Dysard et al. ..... 441/132
3,102,280 A * 9/1963 Williams ..... 441/130
3,363,272 A 1/1968 Channon
3,620,570 A 11/1971 Wilson et al.
3,860,976 A * 1/1975 Suyama ..... 4/575.1
3,984,888 A 10/1976 DeLano
D280,122 S 8/1985 Maertin
D280,123 S 8/1985 Maertin
4,564,240 A 1/1986 Thieme
4,662,852 A 5/1987 Schneider et al.
D290,108 S 6/1987 Wolfe
4,799,910 A * 1/1989 Kellough ..... 441/131
4,837,869 A 6/1989 Simmon
4,926,781 A 5/1990 Bauer
4,973,278 A 11/1990 Williams
4,986,781 A 1/1991 Smith
5,004,296 A 4/1991 Ziegenfuss, Jr.
5,052,965 A 10/1991 Klapp et al.
5,186,667 A 2/1993 Wang
5,213,394 A 5/1993 Tattrie
D350,326 S 9/1994 Grifflin
5,443,409 A 8/1995 Adamson
D366,161 S 1/1996 Arcouette
D373,483 S 9/1996 Peterson
D404,104 S 1/1999 Scheurer et al.
D407,130 S 3/1999 Scheurer et al.
D407,131 S 3/1999 Scheurer et al.

(Continued)

*Primary Examiner*—Milton Nelson, Jr.
(74) *Attorney, Agent, or Firm*—Mark W. Handley

(57) ABSTRACT

A molded foam pool chair (12) is provided by a continuous form (26) of pliable foam material of constant density having varying thicknesses to provide a rigid base portion (30) and an elastic seat portion (28). The rigid base portion (30) extends around and is continuous with the elastic seat portion (28). The rigid base portion (30) defines a peripheral edge (44) having a shape and has cross-sectional areas of sufficient thickness and width to prevent substantial distortion of the shape of the peripheral edge (44) between unloaded and loaded conditions. The elastic seat portion (28) has an upper surface (62), a lower surface (64) and a thickness (48) for receiving a substantial portion of the weight of a person and extending downward within water into a loaded position (68), such that the upper surface (62) of the elastic seat portion (28) when in the loaded position (68), is disposed substantially beneath an unloaded seat position (66) defined by the lower surface (64) when disposed in an unloaded position.

20 Claims, 3 Drawing Sheets

U.S. PATENT DOCUMENTS 5,897,409 A 4/1999 Hartman et al.
D416,063 S 11/1999 Scheurer et al.
6,036,563 A 3/2000 Walker
6,045,423 A 4/2000 Silvia
6,086,150 A 7/2000 Scheurer et al.
6,126,504 A * 10/2000 Day ..... 441/131
6,227,925 B1 5/2001 Boddy
6,296,305 B1 10/2001 Lamka et al.
6,312,054 B1 11/2001 Scheurer et al.
6,527,343 B2 3/2003 Scheurer et al.
6,783,181 B2 8/2004 Scheurer et al.
6,991,285 B1 * 1/2006 Hemenway ..... 297/94
7,182,401 B2 2/2007 Scheurer et al.

* cited by examiner

MOLDED FOAM POOL CHAIR

CROSS-REFERENCE TO RELATED APPLICATION

The present application is a continuation application of U.S. Provisional Application Ser. No. 60/965,026, filed Aug. 16, 2007, entitled "Molded Foam Pool Chair," and invented by Michael L. Perry.

TECHNICAL FIELD OF THE INVENTION

The present invention relates in general to pool chairs, and in particular to a pool chair molded of pliable foam.

BACKGROUND OF THE INVENTION

Prior art pool chairs and floats have been provided for use in swimming pools and the like. Typically, a pool chair is formed of either inflatable sections or soft foam materials to provide floatation during use. Inflatable pool chairs and floats rely on the shape of inflatable sections to provide support and buoyancy during use. Production costs for inflatable pool chairs and floats are incurred by requiring separate manufacturing process steps for forming inflatable sections and then joining the inflatable sections together. Pool chairs made of soft foam materials have plastic frames or metal frames to which the soft foam is secured. Production costs for soft foam chairs with plastic and metal frames are encountered from producing the plastic frames or the metal frames, and then securing the foam to the frames. Prior art pool chairs made of foam materials fixed to separately manufactured rigid frames require both manufacture of the rigid frames and the foam, and then attachment of the foam to the rigid frames for flotation.

SUMMARY OF THE INVENTION

A novel molded foam pool chair is disclosed having a chair base provided by a continuous form of pliable foam material of constant density. The continuous form of pliable foam material varies in thickness to provide a rigid base portion and an elastic seat portion. The rigid base portion has a right side, a left side, a back-side and a front support, or front leg or knee support, which together extend continuously around a periphery of the elastic seat portion. The rigid base portion defines a peripheral edge shape for the molded foam pool chair, and has a cross-sectional area of sufficient thickness and width configured to prevent substantial distortion of the peripheral edge shape between unloaded and loaded conditions of the molded foam pool chair, preferably not distorting a peripheral edge of the chair more than twenty percent of a length or a width thereof. The elastic seat portion has an upper surface, a lower surface and a thickness for receiving a substantial portion of a weight of a person and extending downward within the water into a loaded position, such that the upper surface of the elastic seat portion when in the loaded position is disposed substantially beneath an unloaded seat plane defined by the lower surface when disposed in an unloaded position. The molded foam pool chair preferably includes a pliable foot rest and pliable back rest. The pliable foot rest is preferably included as part of the continuous form. The pliable back rest is preferably molded of the pliable foam material of constant density and is removably secured to an upper side of the back-side of the rigid base portion with posts which extend from the back rest into sockets provided in the back-side of the rigid base. Void spaces may be provided in the bottom of the chair for trapping air to provide enhanced flotation over that of the foam and reduce the unit costs of the foam for the molded foam pool chairs.

DESCRIPTION OF THE DRAWINGS

For a more complete understanding of the present invention and the advantages thereof, reference is now made to the following description taken in conjunction with the accompanying Drawings in which

FIG. 1 is a left side perspective view of a molded foam pool chair made according to the present invention;

FIG. 2 is right side perspective view of the molded foam pool chair;

FIG. 3 is a cross-sectional view of the molded foam pool chair, taken along section line 3-3 of FIG. 2;

FIG. 4 is a longitudinal section view of the molded foam pool chair, taken along section line 4-4 of FIG. 2; and FIGS. 5, 6 and 7 are perspective views of three alternative embodiments of molded foam pool chairs made according to the present invention.

DETAILED DESCRIPTION OF THE INVENTION

Figure 1:
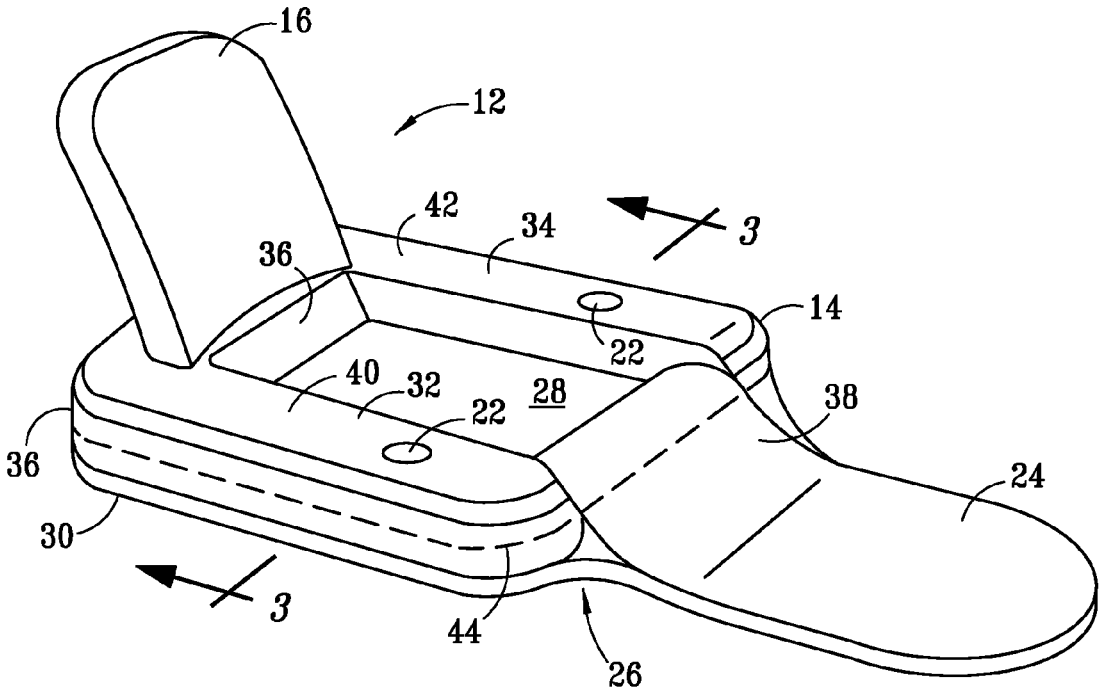
FIGS. 1 through 7 show various aspects for molded foam pool chair devices made according to the present invention, as set forth below.
Figure 2:
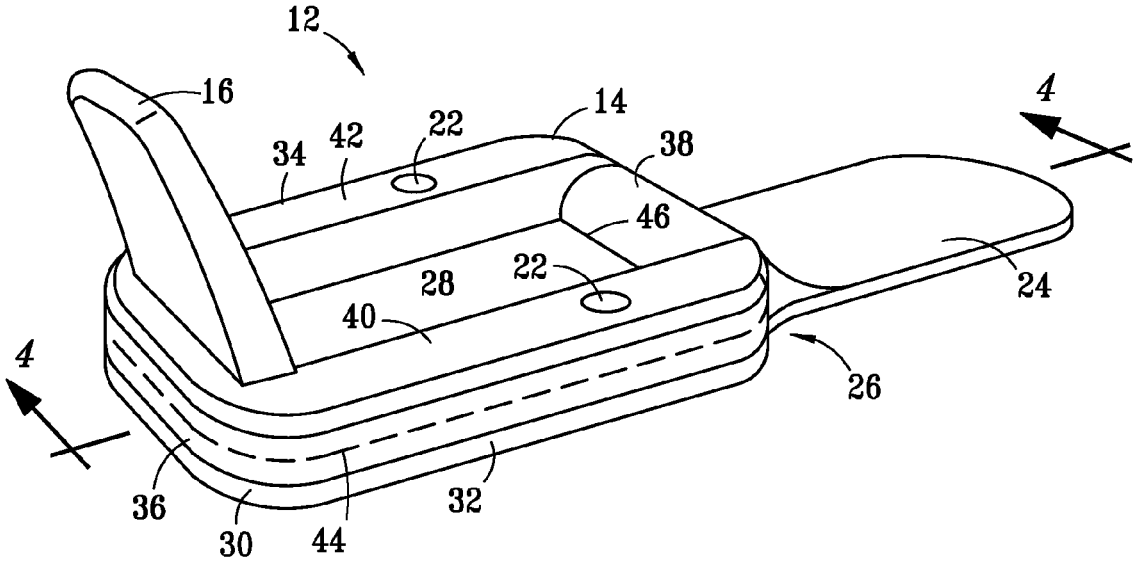

FIGS. 1 and 2 are perspective views of opposite sides of a molded foam pool chair 12 made from a pliable foam material according to the present invention. The molded foam pool chair 12 has a chair base 14 and a back rest 16. The back rest 16 extends to provide both a back rest and a head rest for the molded foam pool chair 12. The back rest 16 is preferably removable with posts 18 extending downward from the back rest 16 for fitting within sockets 20 provided in a top portion of a rearward end of the chair base 14. Preferably, the posts 18 and the sockets 20 are formed of PVC material and are either molded into or glued within respective ones of the back rest 16 and the chair base 14. In other embodiments, the posts 18 may be glued into the sockets 20 such that the back rest is not removable from the chair base 14. The chair base 14 is also preferably provided with void spaces 22 of circular cross section which are sized to provide cup holders. The chair base 14 is shown as including a foot rest 24 which is also formed of the pliable foam material.

The chair base 14 is provided by a single, continuous form 26 of pliable foam material. The foam material providing the continuous form 26 is a pliable foam of constant density, being provided by a single molding process, and may include void spaces of selected shapes, such as the void spaces 22 for cup holders, and spaces for sockets 20 for receiving the posts 18 of the back rest 16. Void spaces 23 may optionally be provided to provide increased flotation over the foam, with the void spaces 23 formed into the bottom of the pool chair 12 to trap air and reduce the costs of the foam materials used in the pool chair 12. The continuous form 26 of pliable foam material providing the chair base 14 has varying thicknesses to provide an elastic seat portion 28 and a rigid base portion 30. The rigid base portion 30 includes a right side 32, a left side 34, a backside 36 and a front side providing a front support 38, preferably extending continuously around and enclosing the elastic seat portion 28. The right side 32 and the left side 34 have thickness and widths such that the upper surface 40 of the right side 32 provides a right arm support and the upper surface 42 of the left side 34 provides a left arm support. The front support 38 provides an upper leg or knee support for users of the chair 12. The rigid base portion 30 of the continuous form 26 has peripheral edges defined by an outer peripheral edge 44 and an inner peripheral edge 46, which in the disclosed embodiment are of rectangular shape. In other embodiments, the continuous form 26 may have peripheral edges of other shapes. The outer peripheral edge 44 and the inner peripheral edge 46 are herein defined to extend in a horizontal plane, parallel to the surface of water in a pool in which the molded foam pool chair 12 is used. The peripheral edge 46 preferably extends around the periphery of the elastic seat portion 28. In other embodiments, a periphery between the elastic seat portion 28 and the rigid base portion 30 may extend through chair portions of tapered thickness of the pliable foam material extending between the elastic seat portion 38 and the rigid base portion 30.

Figures 3, 4:
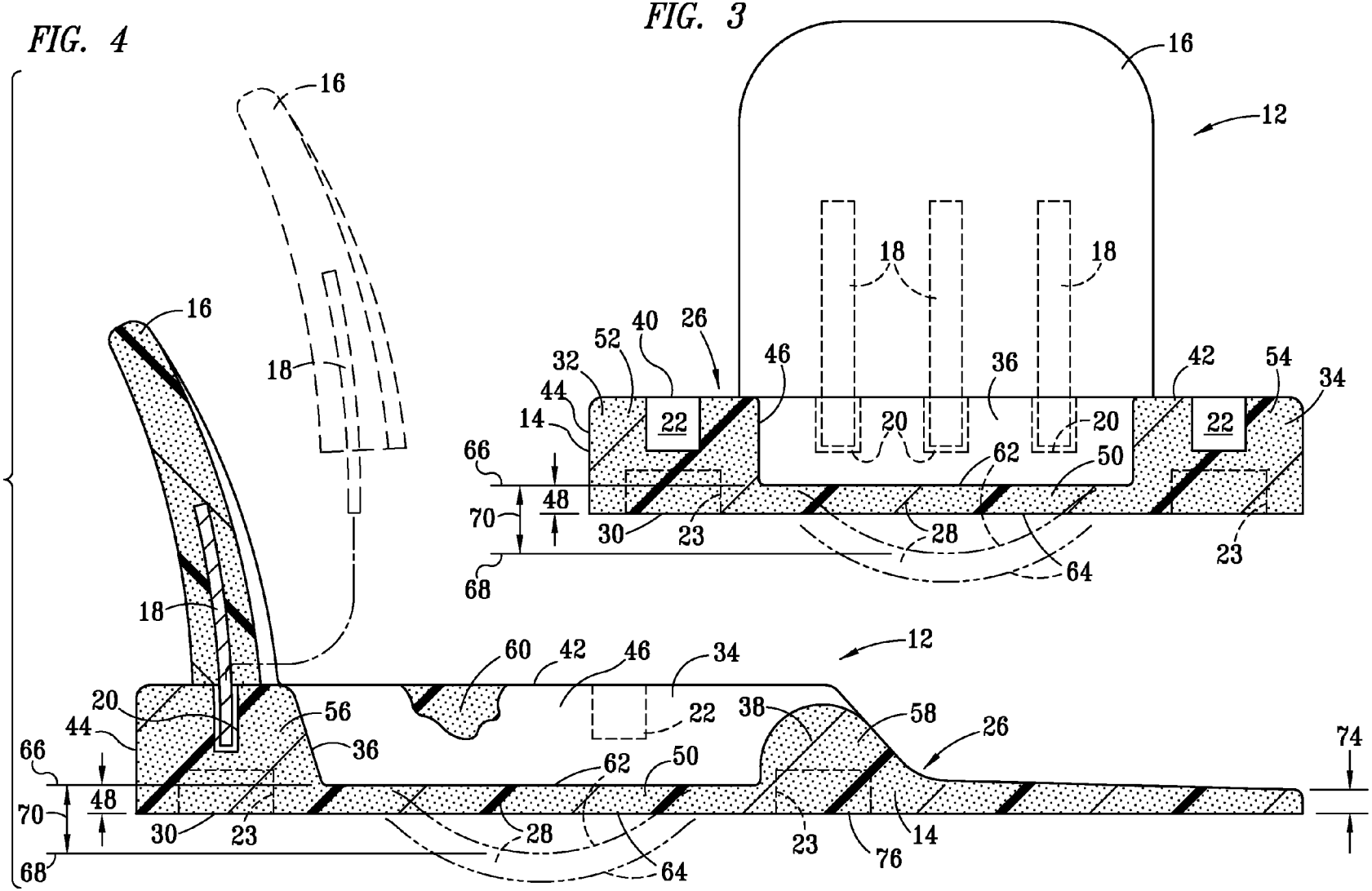

FIGS. 3 and 4 are views of the molded foam pool chair 12, with FIG. 3 being a cross-sectional view taken along section line 3-3 of FIG. 1 and FIG. 4 being a longitudinal section view taken along section line 4-4 of FIG. 2. The elastic seat portion 38 has a thickness 48 to provide a cross-sectional area 50. The rigid base portion 30 has a cross-sectional area 52 for the right side 32, a coss-sectional area 54 for the left side 34, a cross-sectional area 56 for the backside 36, and a cross-sectional area 58 for the front support 38. In a longitudinal direction, the rigid base portion has a longitudinal section area 60, shown in phantom, when taken in a section through the backside 36 and either of the right side portion 32 or the left side portion 34. The continuous form 26 defines a single, unified member of the pliable foam material of constant density, which extends continuously between the elastic seat portion 28 and the rigid base portion 30, such that the pliable foam material extends continuously between the elastic seat portion 28 and the right side 32, the left side 34, the backside 36 and the front support 38. Similarly, the rigid base portion 30 continuously extends, without interruption, completely around and enclosing the elastic seat portion, with the pliable foam material extending continuously between the rearward end of the right side 32 and a right side of the backside 36, between a left side of the backside 36 and the left side 34, and between respective sides of the front support 38 and the right and left sides 34 and 36.

The molded foam pool chair 12 is preferably designed for loaded conditions when a single person ranging in weight from 120 pounds to 250 pounds is seated within the chair 12 in a body of water, such as in a pool. The cross-sectional areas 52, 54, 56 and 58, and the longitudinal section area 60 are selected to have thicknesses and widths configured for providing rigidity to the rigid base portion 30 made of the pliable foam material, such that the outer peripheral edge 44 and the inner peripheral edge 46 will not be substantially distorted so as to fold substantially onto a person sitting in the pool chair 12. As used herein, a distortion which is not substantial is not more than twenty percent of a change in any dimension in the horizontal plane defining the outer peripheral edge portion 44 or the inner peripheral edge portion 46 of the molded foam pool chair 12, preferably referring to the inner peripheral edge portion. For example, for a length or width of the seat section defining the inner peripheral edge 46 of twenty-five inches, a twenty percent maximum distortion would be five inches, or two and one-half inches per side extending toward a person sitting in the pool chair 12. In the embodiment shown, the molded foam pool chair 12 has the outer peripheral edge 44 and the inner peripheral edge 46 which are of rectangular shape, and a distortion which is not substantial will be a change in the length or the width of the molded foam pool chair of not substantially more than twenty percent, as measured in the plane for the outer peripheral edge 44 and the inner peripheral edge 46, between loaded and unloaded conditions. In the preferred embodiment, thickness and widths are not more than approximately seven inches, preferably four and one-half inches, for the rigid base portion 30 to provide cross-sectional areas 52, 54, 56 and 58, and longitudinal section areas 60, such that the outer peripheral edge 44 and the inner peripheral edge 46 will not distort more than twenty percent in either direction. The thickness of the rigid base portion 30 may have slightly larger thickness for larger spans, but preferably not substantially more than seven inches for typical spans for single person molded foam pool chairs. It should be noted that widths, extending parallel to the surface of the water, may be increased separately from thicknesses, extending perpendicular to the surface of the water, with widths or thicknesses being substantially larger than respective thicknesses and widths of cross-sections, and being larger than seven inches.

The elastic seat portion 28 has a top 62 and a bottom 64. An unloaded seat level 66 is shown in object lines prior to a person sitting within the molded foam pool chair 12. A loaded seat level 68 is shown in phantom, showing positioning of the elastic seat portion 28 when a person is sitting in the molded foam pool chair 12, which is a distance 70 beneath the unloaded position 66. The thickness 48 and the cross-sectional area 50 of the elastic seat portion 28 is selected according to the modulus of elasticity of the pliable foam material such that when loaded, the loaded seat level 68 will be disposed beneath the unloaded seat level 66 approximately four to six inches, depending upon the weight of a person applied to the seat, for persons ranging in weight from 120 pounds to 250 pounds. It should be noted that a substantial portion of persons of such weights will be applied, but not all due to the buoyancy of the water in which the chair is used and due to partial support of the arms, back and legs of the person on the right side 32, the left side 34, the backside 36 and the front support 38, respectively. Preferably, the elastic seat portion 28 stretches to have an arcuate shape, and does not extend past the yield point of the pliable foam material such that the elastic seat portion 28 returns to its initial shape at the unloaded seat level 66. Preferably, the elastic seat portion 28 will have a thickness 48 of approximately one and one-half inches for spans of eighteen to twenty-four inches. The elastic seat portion 28 may have slightly larger thickness for larger spans, but preferably not substantially more than one and one-half inches to three inches.

The foot rest 24 is of similar size to the elastic seat portion 28, and has a thickness 74 similar to that of the elastic seat portion 28. In the preferred embodiment, the thickness 74 is approximately one and one-half inches. The foot rest 24 has a planar lower end which is extending as part of a planar bottom surface 76 for the elastic seat portion 28 and the rigid base portion 30.

Figure 5:
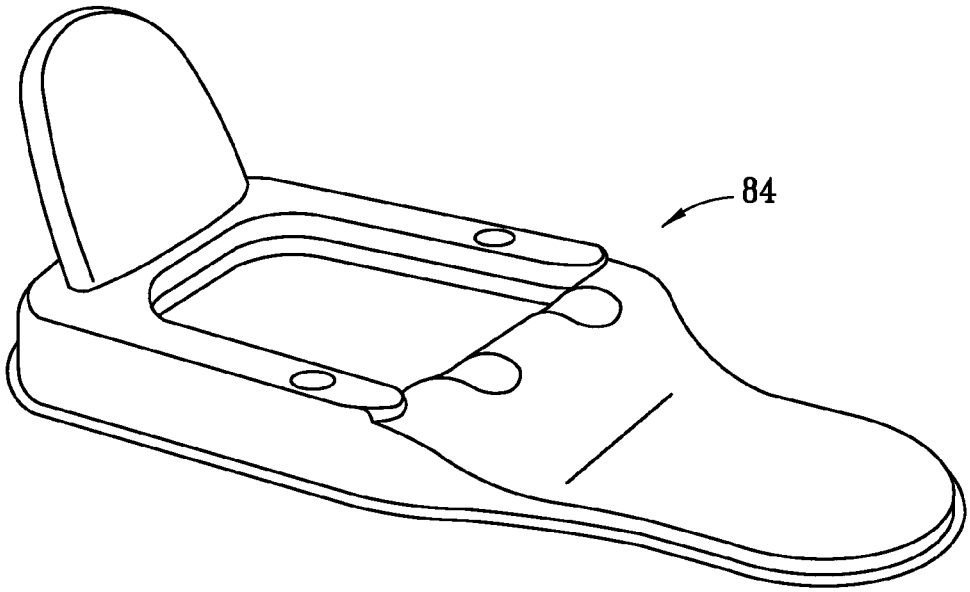
Figure 6:
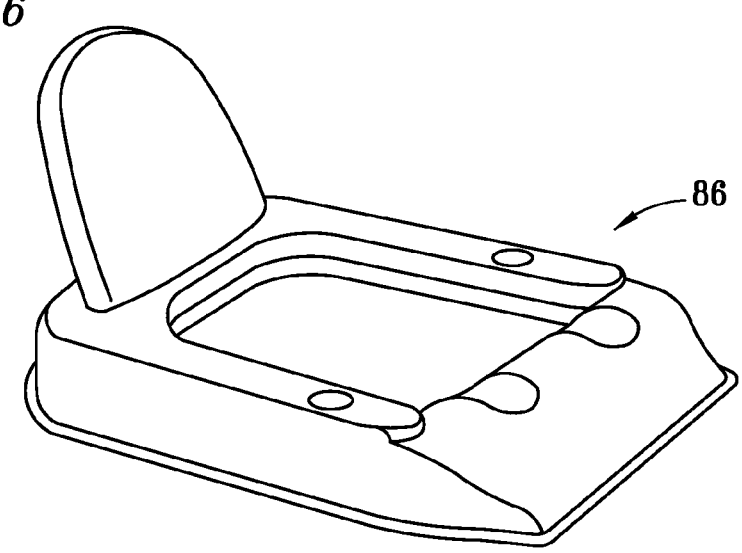
Figure 7:
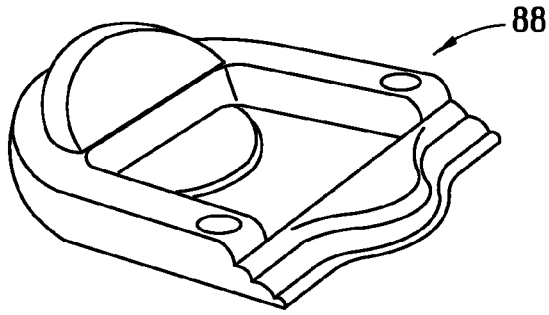

FIGS. 5, 6 and 7 are perspective views of three alternative embodiments of molded foam pool chairs made according to the present invention. FIG. 5 shows a molded foam pool chair 84 having a chair base and a backrest, with the backrest being shorter than the backrest 16 of the molded foam chair 12. The continuous form of pliable foam providing the rigid base portion and elastic seat portion for the chair 84 is of a shorter length than the continuous form 26 of the molded foam pool chair 12. FIG. 6 shows a molded foam chair 86 formed without a foot rest. FIG. 7 shows a molded foam pool chair 88 which does not have a foot rest and which is formed of a continuous form of pliable molded foam to provide a rigid base portion and an elastic seat portion.

The molded pool chairs 12, and 84, 86 and 88 are preferably molded of closed cell foam, such as a polyolefin, a polyethylene foam, or a PVC foam. Like the molded pool chair 12, the mold pool chairs 84, 86 and 88 are molded as a continuous form of the pliable foam material of a single density, such that respective the pliable foam materials extends continuously, such as the continuous form 26 which provides the elastic seat portion 28 and the rigid base portion 30 of the molded foam pool chair 12. Void spaces may also be provided in the closed cell foam for entrapping air to provide flotation.

The present invention provides a molded foam pool chair formed of a pliable foam material without requiring internal support structure separate from the pliable foam material. A chair base is provided from a continuous form of the pliable foam, having thicknesses to define a rigid base portion and an elastic seat portion. The elastic seat portion extends into the water beneath the chair base to lower the center of gravity for a person using the chair and the chair, providing stability for the molded foam pool chair during use. The elastic seat returns to an initial position when unloaded.

Although the preferred embodiment has been described in detail, it should be understood that various changes, substitutions and alterations can be made therein without departing from the spirit and scope of the invention as defined by the appended claims.

What is claimed is:

1. A molded foam pool chair for use in water, comprising:

a continuous form of pliable foam material of constant density having varying thicknesses to define an elastic seat portion and a rigid base portion;

said elastic seat portion having an upper surface and a lower surface spaced apart by at least one of said thicknesses to define a seat thickness, said seat thickness of a size for receiving a substantial portion of a weight of a person and extending downward within the water into a loaded position such that said upper surface in said loaded position is disposed at a loaded seat level located substantially beneath an unloaded seat plane defined by said lower surface when disposed in an unloaded position;

said rigid base portion having a right side, a left side, a backside and a front support which together extend around said elastic seat portion, continuous with said elastic seat portion and defining an inner peripheral edge shape for said molded foam pool chair, wherein said right side is disposed adjacent a right side of said elastic seat portion, said left side is disposed adjacent a left side of said elastic seat portion, said backside is disposed adjacent a rear side of said elastic seat portion, and said front support is disposed adjacent a forward side of said elastic seat portion; and wherein said right side, said left side, said backside and said front support of said rigid base portion have sufficient thicknesses and widths configured to define structural cross sectional areas of said pliable foam material to prevent substantial distortion of an outer peripheral edge shape between unloaded and loaded conditions of said molded foam pool chair.

2. The molded foam pool chair according to claim 1, wherein said continuous form of said pliable foam material has a seat thickness configured for extending downward from said rigid base portion in response to the weight of the person and said structural foam cross-sectional area defined by said rigid base portion has thicknesses and widths to prevent distortion of said length and said width of said inner peripheral edge shape of not substantially more than twenty percent.

3. The molded foam pool chair according to claim 2, wherein said continuous form of said pliable foam material has a seat thickness of not substantially more than three inches and said structural foam cross-sectional area has thicknesses and widths of not substantially more than seven inches.

4. The molded foam pool chair according to claim 3, wherein said pliable foam material is a closed cell foam, and said continuous form of said pliable foam material has said seat thickness which is not substantially less than one and one-half inches and said structural foam cross-sectional area has thicknesses and widths which are not substantially less than four and one-half inches.

5. The molded foam pool chair according to claim 1, further comprising a back rest extending upwards from said backside, said back rest being molded of said pliable foam material.

6. The molded foam pool chair according to claim 5, wherein said back rest and said backside together have mating sockets and posts which inter-fit for securing said back rest to said backside.

7. The molded foam pool chair according to claim 1, further comprising a foot rest extending forward of said front support, wherein said foot rest is defined by said continuous form of said pliable foam material and has a maximum foot rest thickness of not substantially more than one and one-half inches.

8. The molded foam pool chair according to claim 1, wherein said outer peripheral edge shape defines a rectangular shape, and said structural cross-sectional areas of said rigid base portion prevent distortion of said inner peripheral edge shape between unloaded and loaded conditions of said molded foam pool chair of not more than twenty percent of a length and not substantially more than twenty percent of a width of said outer peripheral edge shape.

9. The molded foam pool chair according to claim 1, further comprising a planar underside defined by lowermost sides of said right side, said left side, said backside and said front support, wherein void spaces extend into said planar underside to provide air pockets for floatation.

10. The molded foam pool chair according to claim 1, wherein said loaded seat level is disposed at least four inches beneath said unloaded seat plane.

11. A molded foam pool chair for use in water, comprising:

a continuous form of pliable foam material of constant density having varying thicknesses to define an elastic seat portion and a rigid base portion;

said elastic seat portion having an upper surface and a lower surface spaced apart by at least one of said thicknesses to define a seat thickness, said seat thickness of a size for receiving a substantial portion of a weight of a person and extending downward within the water into a loaded position such that said upper surface in said loaded position is disposed at a loaded seat level located substantially beneath an unloaded seat plane defined by said lower surface when disposed in an unloaded position;

said rigid base portion having a right side, a left side, a backside and a front support which together extend around said elastic seat portion, continuous with said elastic seat portion and defining an inner peripheral edge shape for said molded foam pool chair, wherein said right side is disposed adjacent a right side of said elastic seat portion and defines right arm support, said left side is disposed adjacent a left side of said elastic seat portion and defines a left arm support, said backside is disposed adjacent a rear side of said elastic seat portion, and said front support is disposed adjacent a forward side of said elastic seat portion and defines a leg support; and wherein said right side, said left side, said backside and said front support of said rigid base portion have sufficient thicknesses and widths to define structural cross sectional areas of said pliable foam material to prevent distortion of said inner peripheral edge shape of not more than twenty percent of a length and not substantially more than twenty percent of a width of said inner peripheral edge shape.

12. The molded foam pool chair according to claim 11, further comprising:

a back rest extending upwards from said backside, said back rest being molded of said pliable foam material;

wherein said back rest and said backside together have mating sockets and posts which inter-fit for securing said back rest to said backside; and wherein said back rest is removably secured to said backside by said posts removably engaging with said sockets.

13. The molded foam pool chair according to claim 11, further comprising a foot rest extending forward of said front support, wherein said foot rest is defined by said continuous form of said pliable foam material and has a maximum foot rest thickness of not substantially more than one and one-half inches.

14. The molded foam pool chair according to claim 11, wherein an outer peripheral edge shape is a rectangular shape, and said continuous form of pliable foam material has a planar underside defined by lowermost sides of said right side, said left side, said backside and said front support.

15. The molded foam pool chair according to claim 11, wherein said continuous form of said pliable foam material has a seat thickness of not substantially more than three inches and said structural cross-sectional area has thicknesses and widths of not substantially less than seven inches.

16. The molded foam pool chair according to claim 15, wherein said loaded seat level is disposed at least four inches beneath said unloaded seat plane.

17. A molded foam pool chair for use in water, comprising:

a continuous form of pliable foam material of constant density having varying thicknesses to define an elastic seat portion and a rigid base portion;

said elastic seat portion having an upper surface and a lower surface spaced apart by at least one of said thicknesses to define a seat thickness, said seat thickness not substantially more than three inches for receiving a substantial portion of a weight of a person and extending downward within the water into a loaded position such that said upper surface in said loaded position is disposed at a loaded seat level located at least four inches beneath an unloaded seat plane defined by said lower surface when disposed in an unloaded position;

said rigid base portion having a right side, a left side, a backside and a front support which together extend around said elastic seat portion, continuous with said elastic seat portion and defining a peripheral edge shape for said molded foam pool chair, wherein said right side is disposed adjacent a right side of said elastic seat portion and defines a right arm support, said left side is disposed adjacent a left side of said elastic seat portion and defines a left arm support, said backside is disposed adjacent a rear side of said elastic seat portion, and said front support is disposed adjacent a forward side of said elastic seat portion and defines a leg support; and wherein said right side, said left side, said backside and said front support of said rigid base portion have sufficient thicknesses and widths to define structural cross sectional areas of said pliable foam material which are not substantially less than seven inches to prevent distortion of said peripheral edge shape of not substantially more than twenty percent of a length of an outer peripheral edge shape.

18. The molded foam pool chair according to claim 17, further comprising a foot rest extending forward of said front support, wherein said foot rest is defined by said continuous form of said pliable foam material which defines a seat thickness of not substantially more than one and one-half inches.

19. The molded foam pool chair according to claim 18, wherein said outer peripheral edge shape defines a rectangular shape, and an underside defined by lowermost sides of said right side, said left side, said backside and said front support defining an outer peripheral edge shape for said molded foam pool chair, wherein said underside defines a planar surface, void spaces are formed into said underside to provide air pockets for flotation, and said seat thickness is not substantially less than one and one-half inches and said thickness of said structural cross sectional areas is approximately four and one-half inches.

20. The molded foam pool chair according to claim 19, further comprising a back rest extending upwards from said backside, said back rest being molded of said pliable foam material; and wherein said back rest and said backside together have mating sockets and posts which inter-fit for securing said back rest to said backside.

* * * * *